US007371315B2

(12) United States Patent
Benazzi et al.

(10) Patent No.: US 7,371,315 B2
(45) Date of Patent: May 13, 2008

(54) FLEXIBLE METHOD FOR PRODUCING OIL BASES AND DISTILLATES BY HYDROISOMERIZATION-CONVERSION ON A WEAKLY DISPERSED CATALYST FOLLOWED BY A CATALYCTIC DEWAXING

(75) Inventors: Eric Benazzi, Chatou (FR); Nathalie Marchal-George, Saint Genis Laval (FR); Tivadar Cseri, Courbevoie (FR); Pierre Marion, Antony (FR); Christophe Gueret, St Romain cn Gal (FR); Slavik Kasztelan, Rueil Malmaison (FR)

(73) Assignee: Institut Francáis du Petrole, Rueil Malmaison Cedex (FR)

( * ) Notice: Subject to any disclaimer, the term of this patent is extended or adjusted under 35 U.S.C. 154(b) by 658 days.

(21) Appl. No.: 10/450,400

(22) PCT Filed: Dec. 13, 2001

(86) PCT No.: PCT/FR01/03976

§ 371 (c)(1),
(2), (4) Date: Jan. 8, 2004

(87) PCT Pub. No.: WO02/48290

PCT Pub. Date: Jun. 20, 2002

(65) Prior Publication Data

US 2004/0134834 A1 Jul. 15, 2004

(30) Foreign Application Priority Data

Dec. 15, 2000 (FR) ..... 00 16368

(51) Int. Cl.
*C10G 69/02* (2006.01)

(52) U.S. Cl. ..... 208/58; 208/27; 208/97

(58) Field of Classification Search ..... 208/18, 208/27, 58, 62, 97

See application file for complete search history.

(56) References Cited

U.S. PATENT DOCUMENTS

| | | | | |
|---|---|---|---|---|
| 6,332,974 | B1 * | 12/2001 | Wittenbrink et al. | 208/18 |
| 6,475,374 | B1 * | 11/2002 | Leta et al. | 208/62 |
| 6,602,402 | B1 * | 8/2003 | Benazzi et al. | 208/58 |

FOREIGN PATENT DOCUMENTS

| | | |
|---|---|---|
| FR | 2698863 | 6/1994 |
| FR | 2792946 | 11/2000 |
| WO | WO 99/41336 | 8/1999 |

* cited by examiner

*Primary Examiner*—Glenn Caldarola
*Assistant Examiner*—Prem C. Singh
(74) *Attorney, Agent, or Firm*—Millen, White, Zelano & Branigan, P.C.

(57) ABSTRACT

A process for production of very high-quality base oils, and simultaneous production of high-quality middle distillates, comprises the successive stages of hydroisomerization and catalytic dewaxing. The hydroisomerization takes place in the presence of a catalyst containing at least one noble metal deposited on an amorphous acid support, the metal dispersion being less than 20%. The support is preferably an amorphous silica-alumina. The catalytic dewaxing takes place in the presence of a catalyst containing at least one hydrodehydrogenating element (Group VIII) and at least one molecular sieve chosen from ZBM-30, EU-2, and EU-11.

21 Claims, 2 Drawing Sheets

Figure 1:
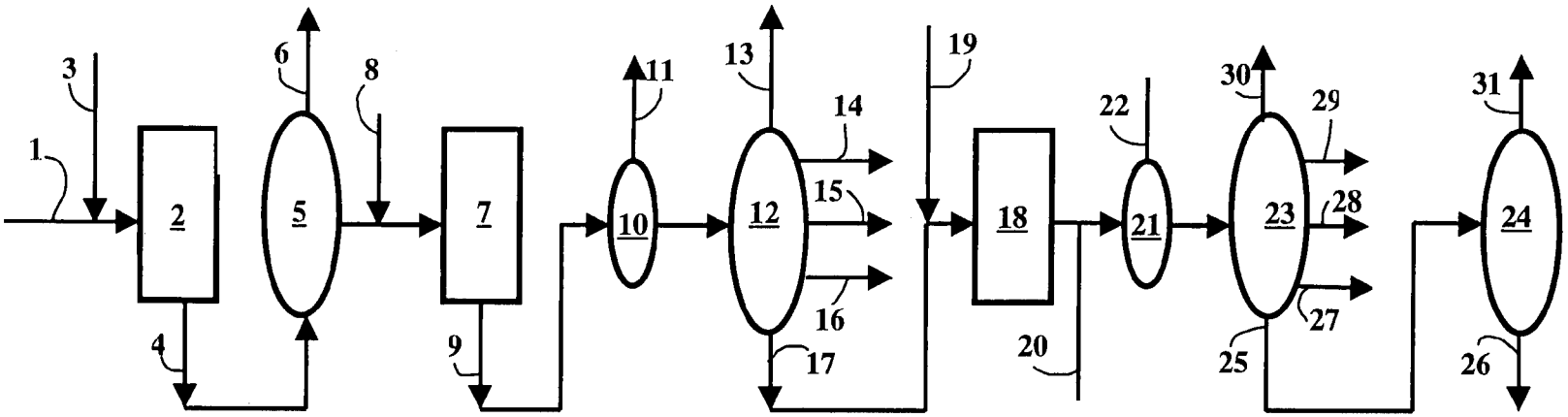

FLEXIBLE METHOD FOR PRODUCING OIL BASES AND DISTILLATES BY HYDROISOMERIZATION-CONVERSION ON A WEAKLY DISPERSED CATALYST FOLLOWED BY A CATALYCTIC DEWAXING

The present invention relates to an improved process for producing very high-quality base oils, i.e. possessing a high viscosity index (VI), good UV stability and a low pour point, from hydrocarbon charges (and preferably from hydrocarbon charges resulting from the Fischer-Tropsch process or from hydrocracking residues) with optionally simultaneously the production of middle distillates (in particular gasoils, kerosene) of very high quality, i.e: possessing a low pour point and a high cetane number.

PRIOR ART

High-quality lubricants are of paramount significance for the good operation of modern machinery, cars and lorries.

These lubricants are most often obtained by a succession of refining stages, allowing the improvement of the properties of an oil cut. In particular, a treatment of heavy oil fractions with high contents of linear or slightly branched paraffins is necessary in order to obtain base oils of good quality, with the best possible yields, by an operation which aims to remove the linear or very slightly branched paraffins from the charges which will then be used as base oils.

In fact, paraffins of high molecular weight which are linear or very slightly branched and which are present in oils lead to high pour points and therefore to coagulation phenomena for uses at low temperature. In order to reduce the pour point values, these paraffins, which are linear, unbranched or very slightly branched must be completely or partially removed.

Another means is catalytic treatment in the presence or absence of hydrogen and, given their form selectivity, zeolites are among the catalysts most used.

Catalysts based on zeolites such as ZSM-5, ZSM-11, ZSM-12, ZSM-22, ZSM-23, ZSM-35 and ZSM-38 have been described for their use in these processes.

All the catalysts currently used in hydroisomerization are of the bifunctional type, combining an acid function with a hydrogenating function. The acid function is provided by supports with large surface areas (generally 150 to 800 $m^2.g^{-1}$) having a surface acidity, such as halogenated (in particular chlorinated or fluorinated) aluminas, phosphorated aluminas, combinations of boron and aluminium oxides, amorphous silica-aluminas, and silica-aluminas. The hydrogenating function is provided either by one or more metals of Group VIII of the periodic table of the elements, such as iron, cobalt, nickel, ruthenium, rhodium, palladium, osmium, indium and platinum, or by a combination of at least one metal of Group VI, such as chromium, molybdenum and tungsten and at least one metal of Group VIII.

The balance between the two acid and hydrogenating functions, is the basic parameter which governs the activity and selectivity of the catalyst. A weak acid function and a strong hydrogenating function produce catalysts which are not very active and selective vis-à-vis isomerization, whereas a strong acid function and a weak hydrogenating function produce catalysts which are highly active and selective vis-à-vis cracking. A third possibility is to use a strong acid function and a strong hydrogenating function in order to obtain a highly active catalyst which is however also very selective vis-à-vis isomerization. It is therefore possible, by judiciously choosing each of the functions, to adjust the catalyst's activity/selectivity balance.

The Applicant is therefore proposing, according to the process described in the invention, to produce jointly middle distillates of very good quality, and base oils with a VI and pour point at least equal to those obtained with a hydrorefining and/or hydrocracking process.

SUBJECT OF THE INVENTION

The Applicant has concentrated its research efforts on developing an improved process for producing very high-quality lubricating oils and high-quality middle distillates from hydrocarbon charges, and preferably from hydrocarbon charges resulting from the Fischer-Tropsch process or from hydrocracking residues.

The present invention thus relates to a series of processes for the joint production of very high-quality base oils and very high-quality middle distillates (in particular gasoils), from oil cuts. The oils obtained have a high viscosity index (VI), low volatility, good UV stability and a low pour point.

More precisely, the invention relates to a process for the production of oils from a hydrocarbon charge (of which preferably at least 20% by volume has a boiling temperature of at least 340° C.), said process comprising the following successive stages:

(a) conversion of the charge with simultaneous hydroisomerization of at least part of the n-paraffins in the charge, said charge having a sulphur content of less than 1000 ppm by weight, a nitrogen content of less than 200 ppm by weight, a metals content of less than 50 ppm by weight, an oxygen content of at most 0.2% by weight (said stage preferably taking place at a temperature of 200-500° C., under a pressure of 2-25 MPa, at a volume rate of 0.1-10 $h^{-1}$, in the presence of hydrogen, at a rate generally between 100 and 2000 1.H2/1 of charge), in the presence of a catalyst containing at least one noble metal applied to an amorphous acid support, the noble metal dispersion being less than 20%.

(b) catalytic dewaxing of at least part of the effluent originating in stage (a) (preferably carried out at a temperature of 200-500° C., under a pressure of 1-25 MPa, at an hourly volume rate of 0.05-50 $h^{-1}$, in the presence of 50-2000 litres of hydrogen/litre of effluent entering stage (b)), in the presence of a catalyst comprising at least one hydro-dehydrogenating element and at least one molecular sieve chosen from ZBM-30, EU-2 and EU-11.

Stage (a) is therefore optionally preceded by a hydrotreatment stage, generally carried out at a temperature of 200-450° C., under a pressure of 2 to 25 MPa, at a volume rate of 0.1-6 $h^{-1}$, in the presence of hydrogen in a hydrogen/hydrocarbon volume ratio of 100-2000 1/1 and in the presence of an amorphous catalyst comprising at least one metal of Group VIII and at least one metal of Group VI B.

All the effluent produced in stage (a) can be passed to stage (b).

Stage (a) is optionally followed by a separation of the light gases from the effluent obtained at the end of stage (a).

The effluent resulting from the hydroisomerization-conversion treatment is preferably subjected to a distillation stage (preferably atmospheric) in order to separate the compounds having a boiling point below 340° C. (gas, gasoline, kerosene, gasoil) from the products having an initial boiling point above at least 340° C., and which form the residue. Thus generally at least one middle distillate fraction having a pour point of at most −20° C., and a cetane number of at least 50 are separated.

The catalytic dewaxing stage. (b) is then applied at least to the residue resulting from the distillation, which contains compounds with a boiling point above at least 340° C. In another embodiment of the invention, the effluent produced in stage (a) is not distilled before stage (b) is implemented. At the very most, it undergoes a separation of at least part of the light gases (by flash etc.) and it is then subjected to the catalytic dewaxing.

Stage (b) is preferably carried out with a catalyst containing at least one molecular sieve, the microporous system of which has at least one main type of channels with pore openings having 9 or 10 T atoms, T being chosen from the group formed by Si, Al, P, B, Ti, Fe, Ga, alternating with an equal number of oxygen atoms, the distance between two openings of accessible pores and comprising 9 or 10 T atoms being at most equal to 0.75 nm.

The effluent resulting from the dewaxing treatment is advantageously subjected to a distillation stage advantageously comprising an atmospheric distillation and a distillation under vacuum in order to separate at least one oil fraction at a boiling point above at least 340° C. Most often it has a pour point below −10° C. and a VI above 95, a viscosity at 100° C. of at least 3 cSt (i.e. 3 mm2/s). This distillation stage is essential when there is no distillation between stages (a) and (b).

The effluent resulting from the dewaxing treatment, optionally distilled, is advantageously subjected to a hydrofinishing treatment.

DETAILED DESCRIPTION OF THE INVENTION

The process according to the invention comprises the following stages:

The Charge

The hydrocarbon charge from which the high-quality oils and, optionally, middle distillates are obtained, preferably contains at 20% by volume of compounds boiling above 340° C., preferably at at least 350° C. and advantageously at at least 380° C. This does not mean that the boiling point is 380° C. and above, but 380° C. or above.

The charge contains n-paraffins. The charge is preferably an effluent produced in a Fischer-Tropsch unit. A wide variety of charges can be treated by the process.

The charge can also be, for example, vacuum distillates, resulting from the direct distillation of crude, or conversion units such as FCC, coker or viscoreduction, or resulting from aromatics extraction units, or resulting from hydrotreatment or hydroconverson of ATRs (atmospheric residues) and/or VRs (vacuum residues), or the charge can be a deasphalted oil, or a hydrocracking residue, for example resulting from VDS or any mixture of the abovementioned charges. The above list is not exhaustive.

Generally, the charges suitable for the desired oils have an initial boiling point above at least 340° C., and, still better, above at least 370° C.

The charge introduced in hydroisomerization-conversion stage (a) must be clean. By clean charge is meant charges, the sulphur content of which is less than 1000 ppm by weight and preferably less than 500 ppm by weight, and still more preferably less than 300 ppm by weight, or, better, 200 ppm by weight. The nitrogen content is less than 200 ppm by weight, and preferably less than 100 ppm by weight and still more preferably less than 50 ppm by weight. The metals content such as nickel and vanadium of the charge is extremely reduced, i.e. less than 50 ppm by weight, and more advantageously less than 10 ppm by weight, or, better, less than 2 ppm by weight.

In the case where the levels of unsaturated or oxygenated products are likely to mean too great a deactivation of the catalytic system, the charge (for example resulting from the Fischer-Tropsch process) will, before entering the hydroisomerization zone, have to undergo a hydrotreatment in a hydrotreatment zone. The hydrogen is reacted with the charge in contact with a hydrotreatment catalyst, the role of which is to reduce the level of unsaturated and oxygenated hydrocarbon molecules (produced, for example during the Fischer-Tropsch synthesis).

The oxygen content is thus reduced to at most 0.2% by weight.

In the case where the charge to be treated is not clean in the sense defined above, it is subjected, in a first phase, to a preliminary hydrotreatment stage, during which it is brought into contact, in the presence of hydrogen, with at least one catalyst comprising an amorphous support and at least one metal having a hydro-dehydrogenation function, provided for example, by at least one element of Group VIB, and at least one element of Group VIII, at a temperature between 200 and 450° C., preferably 250-450° C., advantageously 330-450° C. or 360-420° C., under a pressure between 5 and 26 MPa or, better, less than 20 MPa, preferably between 5 and 20 MPa, the volume rate being between 0.1 and 6 $h^{-1}$, preferably 0.3-3 $h^{-1}$, and the quantity of hydrogen introduced is such that the hydrogen/hydrocarbon volume ratio is between 100 and 2000 litres/litre.

The support is generally based on (preferably essentially constituted by) amorphous alumina or silica-alumina; it can also contain boron oxide, magnesia, zirconia, titanium oxide or a combination of these oxides. The hydro-dehydrogenation function is preferably fulfilled by at least one metal or metal compound of Groups VIII and VIB, preferably chosen from: molybdenum, tungsten, nickel and cobalt.

This catalyst can advantageously contain phosphorus; in fact it is known in the prior art that the compound provides two advantages to the hydrotreatment catalysts: ease of preparation, in particular during the impregnation of the nickel and molybdenum solutions, and better hydrogenation activity.

The preferred catalysts are NiMo and/or NiW catalysts on alumina, also NiMo and/or NiW catalysts on alumina doped with at least one element included in the group of atoms formed by phosphorus, boron, silicon and fluorine, or NiMo and/or NiW catalysts on silica-alumina, or on silica-alumina titanium oxide doped or not doped with at least one element included in the group of atoms formed by phosphorus, boron, fluorine and silicon.

The total concentration of oxides of metals from Groups VIB and VIII is between 5 and 40% by weight, and preferably between 7 and 30%, and the weight ratio expressed as metal oxide between metal (or metals) from Group VI over a metal (or metals) of Group VIII is preferably between 20 and 1.25 and still more preferably between 10 and 2. The concentration of phosphorus oxide $P_2O_5$ will be below 15% by weight and preferably below 10% by weight.

The product obtained at the end of the hydrotreatment undergoes, if necessary, intermediate separation of the water ($H_2O$), $H_2S$ and $NH_3$ in order to reduce the water, $H_2S$ and $NH_3$ levels respectively to less than at most 100 ppm, 200 ppm and 50 ppm in the charge introduced in stage (a). At this stage, it is possible to provide an optional separation of the products having a boiling point below 340° C., in order only to treat one residue in stage (a).

In the case where a hydrocracking residue is treated, a charge is then present which has already undergone a hydrotreatment and a hydrocracking. The clean charge can then be treated directly in stage (a).

Generally, the hydrocracking takes place on a zeolite catalyst, more often based on a Y zeolite, and in particular on dealuminated Y zeolites.

The catalyst also contains at least one non-noble metal of Group GVIII, and at least one metal of Group VIB.

Stage (a): Hydroisomerization-Conversion.

The catalyst

Stage (a) takes place in the presence of hydrogen and in the presence of a bifunctional catalyst comprising at least one noble metal applied to an amorphous acid support, the noble metal dispersion being less than 20%.

During this stage, the n-paraffins, in the presence of a bifunctional catalyst, undergo an isomerization then optionally a hydrocracking in order to lead respectively to the formation of isoparaffins and lighter cracking products such as gasoils and kerosene.

The fraction of noble metal particles less than 2 nm in size preferably represents at most 2% by weight of the noble metal applied to the catalyst.

Advantageously, at least 70% (preferably at least 80% and, better, at least 90%) of the noble metal particles are greater than 4 nm in size (% by number).

The support is amorphous, it does not contain a molecular sieve; nor does the catalyst contain a molecular sieve.

The acid support can be chosen from the group formed by a silica-alumina, boron oxide, a zirconia alone or mixed with each other or with a matrix (non-acid, for example).

The amorphous acid support is generally chosen from the group formed by a silica-alumina, a halogenated (preferably fluorinated) alumina, an alumina doped with silicon (deposited silicon), a mixture of titanium oxide, a sulphated zirconia, a zirconia doped with tungsten, and mixtures of these with each other or with at least one amorphous matrix chosen from the group formed by alumina, titanium oxide, silica, boron oxide, magnesium, zirconia, clay for example.

The preferred supports are amorphous silica-alumina and (amorphous) silica-alumina titanium oxide.

Measurement of acidity is well known to the person skilled in the art. It can be carried out for example by temperature-programmed desorption (TPD) with ammonia, by infra-red measurement of absorbed molecules (pyridine, CO etc.) catalytic cracking or hydrocracking test on model molecule etc.

A preferred catalyst, according to the invention, comprises (is preferably essentially constituted by) 0.05 to 10% by weight of at least one noble metal of Group VIII applied to an amorphous silica-alumina support.

Further details of the catalyst's characteristics are as follows:

Silica content: the preferred support used for the production of the catalyst described in this patent is made up of silica $SiO_2$ and alumina $Al_2O_3$ immediately following synthesis. The silica content of the support, expressed as a weight percentage, is generally between 1 and 95%, advantageously between 5 and 95%, and preferably between 10 and 80% and still more preferably between 20 and 70%, even between 22 and 45%. This content is perfectly measured using X-ray fluorescence.

Nature of the noble metal: for this particular type of reaction, the metal function is provided by at least one noble metal of Group VIII of the periodic table of the elements, and more particularly platinum and/or palladium.

Noble metal content: the noble metal content, expressed in weight % of metal relative to the catalyst, is between 0.05 and 10 and, more preferably between 0.1 and 5.

Dispersion of the noble metal: the dispersion, representing the fraction of metal accessible to the reagent relative to the total quantity of metal in the catalyst, can be measured, for example by $H_2/O_2$ titration. The metal is previously reduced, i.e. it undergoes a treatment under a hydrogen flow at high temperature under these conditions, such that all the platinum atoms accessible to the hydrogen are converted to metal form. Subsequently, an oxygen flow is passed, under appropriate operating conditions, so that all the reduced-platinum atoms accessible to the oxygen are oxidized in $PtO_2$ form. By calculating the difference between the quantity of oxygen introduced and the quantity of oxygen leaving, the quantity of oxygen consumed is arrived at; thus, from this last value, the quantity of platinum accessible to the oxygen can then be deduced. The dispersion is then equal to the ratio of the quantity of platinum accessible to the oxygen, to the total quantity of platinum in the catalyst. In our case, the dispersion is less than 20%, it is generally greater than 1% or, better, 5%.

Size of the particles measured by Transmission Electron Microscopy: in order to determine the size and distribution of the metal particles, we used Transmission Electron Microscopy. After preparation, the sample of catalyst is finely ground in an agate mortar, then dispersed in ethanol by ultrasound. Samples are taken from different places ensuring that they are well representative, and placed on a copper grid covered with a thin carbon film. The grids are then air-dried under an infra-red lamp before being introduced into the microscope for observation. In order to estimate the average size of the noble metal particles, several hundred measurements are carried out, starting with several tens of plates. This set of measurements makes it possible to produce a particle-size-distribution histogram. Thus, we can estimate precisely the proportion of particles corresponding to each particle size range.

Noble metal distribution: the noble metal distribution represents the distribution of the metal inside the catalyst grain; the metal can be well or poorly dispersed. Thus, it is possible to obtain platinum that is poorly distributed (for example detected in a crown, the thickness of which is clearly less than the radius of the grain), but well dispersed, i.e. all the platinum atoms, situated in a crown, will be accessible to the reagents. In our case, the platinum distribution is good, i.e. the platinum profile, measured according to the Castaing microprobe method, has a distribution coefficient greater than 0.1, advantageously greater than 0.2 and preferably greater than 0.5.

BET surface: the BET surface of the support is generally between 100 $m^2/g$ and 500 $m^2/g$, and preferably between 250 $m^2/g$ and 450 $m^2/g$, and for silica-alumina based supports, still more preferably between 310 $m^2/g$ and 450 $m^2/g$.

Overall pore volume of the support: for silica-alumina based supports, this is generally less than 1.2 ml/g, and preferably between 0.3 and 1.1 ml/g and still more advantageously less than 1.05 ml/g.

The preparation and forming of the silica-alumina and any support generally is carried out by standard methods well known to the person skilled in the art. Advantageously, prior to the impregnation of the metal, the support can undergo a calcination, such as, for example a heat treatment at 300-750° C. (preferably 600° C.), during a period of between 0.25 and 10 hours (preferably 2 hours) under 0-30% by volume of water vapour (approximately 7.5% being preferred for a silica-alumina support).

The metal salt is introduced by one of the standard methods used in order to deposit the metal (preferably platinum) on the surface of a support. One of the preferred methods is dry impregnation which consists of introducing metal salt into a volume of solution which is equal to the porous volume of the mass of catalyst to be impregnated. Before the reduction operation and in order to obtain the metal-particles size distribution, the catalyst undergoes a calcination under humidified air at 300-750° C. (preferably 550° C.) for 0.25-10 hours (preferably 2 hours). The partial $H_2O$ pressure during the calcination is for example 0.05 bar to 0.50 bar (preferably 0.15 bar). Other known treatment methods making it possible to obtain dispersion of less than 20% are suitable within the framework of the invention.

In this stage (a), the conversion is most often accompanied by a hydroisomerization of the paraffins. The process has the advantage of flexibility: depending on the degree of conversion, production is directed more towards oils or middle distillates. The conversion generally varies between 5 and 90%.

Before use in the hydroisomerization-conversion reaction, the metal contained in the catalyst is reduced. One of the preferred metal-reduction methods is treatment under hydrogen at a temperature between 150° C. and 650° C. and a total pressure between 0.1 and 25 MPa. For example, a reduction consists of a stage at 150° C. lasting 2 hours, then a rise in temperature to 450° C. at the rate of 1° C./minute, then a stage lasting 2 hours at 450° C.; throughout this reduction stage, the hydrogen flow rate is 1000 1 of hydrogen/1 of catalyst. It should also be noted that any ex-situ reduction method is suitable.

The operating conditions under which this stage (a) is carried out are important.

The pressure will generally be maintained at between 2 and 25 MPa (most often at least 5 MPa) and preferably between 2 (or 3) and 20 MPa and advantageously between 2 and 18 MPa, the volume rate usually being between 0.1 $h^{-1}$ and 10 $h^{-1}$, and preferably between 0.2 $h^{-1}$ and 10 $h^{-1}$ and advantageously between 0.1 $h^{-1}$ or 0.5 $h^{-1}$ and 5.0 $h^{-1}$, and a hydrogen flow rate advantageously between 100 and 2000 litres of hydrogen per litre of charge and preferably between 150 and 1500 litres of hydrogen per litre of charge.

The temperature used in this stage is more often between 200° C. and 500° C. (or 450° C.) and preferably between 250° C. and 450° C., advantageously between 300° C. and 450° C., and still more advantageously above 340° C., for example between 320 and 450° C.

The hydrotreatment and hydroisomerization-conversion stages can be carried out on the two types of catalysts in (two or more) different reactors, or/and on at least two catalytic beds installed in the same reactor.

The use of the catalyst below described in stage (a) has the effect of increasing the viscosity index (VI). More generally, it is noted that the increase in VI is at least 2 points, the VIs being measured on charge (residue) dewaxed with solvent, and on the product produced in stage (a) also dewaxed with solvent, aiming at a pour point temperature between −15 and −20° C.

A VI increase of at least 5 points is generally obtained, and very often of more than 5 points, even 10 points or more than 10 points.

It is possible to control the VI increase, in particular from the conversion measurement. It will thus be possible to optimize production towards oils with a high VI or towards higher oil yields, but with less high VIs.

In parallel with the VI increase, a lowering of the pour point is most often obtained, which can range from a few degrees to 10-15° C. or even more (25° C. for example). The extent of the lowering varies depending on the conversion and thus on the operational conditions and the charge.

Treatment of the Effluent Produced in Stage (a)

In a preferred embodiment, all of the effluent originating in the hydroisomerization-conversion stage (a) can be treated in the dewaxing stage (b). In a variant, it can undergo a separation of at least one part (and preferably at least a major part) of light gases which include hydrogen, and optionally also of hydrocarbon compounds with at most 4 carbon atoms. The hydrogen can be separated previously. The embodiment (apart from the variant) with all the effluent from stage (a) being passed into stage (b), is economically attractive, since a single distillation unit is used at the end of the process. Moreover, in the final distillation (after catalytic dewaxing or subsequent treatments) a gasoil for very cold weather is obtained.

Advantageously, in another embodiment, the effluent produced in stage (a) is distilled in order to separate the light gases and also to separate at least one residue containing the compounds with a boiling point higher than at least 340° C. This is preferably an atmospheric distillation.

Distillation can advantageously be carried out in order to obtain several fractions (gasoline, kerosene, gasoil for example), with a boiling point of at most 340° C. and a fraction (called residue) with an initial boiling point higher than at least 340° C. and, better, higher than 350° C. and preferably of at least 370° C. or 380° C.

According to a preferred variant of the invention, this fraction (residue) will then be treated in the catalytic dewaxing stage, i.e. without undergoing vacuum distillation. But in another variant, a vacuum distillation can be used.

In an embodiment aimed more at producing middle distillates, and still according to the invention, it is possible to recycle part of the residue produced in the separation stage to the reactor containing the hydroisomerization-conversion catalyst in order to convert it and increase the production of middle distillates.

Generally, in this text middle distillates means the fraction(s) with an initial boiling point of at least 150° C., and a final boiling point up to just before the residue, i.e. generally up to 340° C., 350° C. or preferably below 370° C. or 380° C.

The effluent produced in stage (a) can, before or after distillation, undergo other treatments such as, for example, an extraction of at least some of the aromatic compounds.

Stage (b): Catalytic Hydrodewaxing

At least part of the effluent produced in stage (a), effluent having optionally undergone the separations and/or treatments described above, is then subjected to a catalytic dewaxing stage in the presence of hydrogen and a hydrodewaxing catalyst comprising an acid function, a hydro-dehydrogenating function and at least one matrix.

It should be noted that the compounds boiling above at least 340° C. are always subjected to the catalytic dewaxing.

The Catalyst

The acid function is provided by at least one molecular sieve and preferably a molecular sieve whose microporous system has at least one main type of channels whose openings are formed from rings containing 9 or 10 T atoms. T atoms are tetrahedral atoms making up the molecular sieve and can be at least one of the elements contained, in the following group of atoms (Si, Al, P, B, Ti, Fe, Ga). In the rings forming the channel openings, the T atoms, defined above, alternate with an equal number of oxygen atoms. Thus to say that the openings are formed from rings containing 9 or 10 oxygen atoms is equivalent to saying that they are formed from rings containing 9 or 10 T atoms.

The catalyst according to the invention comprises at least one sieve chosen from ZBM-30, EU-2 and EU-11. It can also comprise at least one sieve having the above characteristics.

The molecular sieve used to make up the hydrodewaxing catalyst can also comprise other types of channels, whose openings are however formed from rings containing at least 10 T atoms or oxygen atoms.

The molecular sieve used to make up the preferred catalyst also has a bridge width, the distance between two pore openings, as defined above, which is no greater than 0.75 nm (1 nm=$10^{-9}$ m), preferably between 0.50 nm and 0.75 nm, and still more preferably between 0.52 nm and 0.73 nm; such sieves make it possible to obtain good catalytic performances in the hydrodewaxing stage.

The bridge width is measured by using a graphic and molecular modelling tool such as Hyperchem or Biosym, which makes it possible to construct the surface of the molecular sieves in question and, taking account the ion rays of the elements present in the sieve structure, to measure the bridge width.

The use of molecular sieves thus selected, under the conditions described above, from the numerous molecular sieves already existing, makes it possible in particular to produce products with a low pour point and high viscosity index with good yields within the framework of the process according to the invention.

The molecular sieves that can be used to make up the preferred catalytic hydrodewaxing catalyst are, for example, the following zeolites: Ferrierite, NU-10, EU-13, EU-1.

The molecular sieves also used to make up the hydrodewaxing catalyst are preferably contained within the group formed by ferrierite and the zeolite EU-1.

Generally, the hydrodewaxing catalyst can also comprise at least one zeolite chosen from the group formed by NU-10, EU-1, EU-13, ferrierite, ZSM-22, Theta-1, ZSM-50, NU-23, ZSM-35, ZSM-38, ZSM-23, ZSM-48, ISI-1, KZ-2, ISI-4, KZ-1.

The content by weight of the molecular sieve in the hydrodewaxing catalyst is between 1 and 90%, preferably between 5 and 90% and still more preferably between 10 and 85%.

The matrices used for formation of the catalyst include the examples in the following list, which is not exhaustive: alumina gels, aluminas, magnesia, amorphous silica-aluminas, and mixtures of these. Techniques such as extrusion, pelletization or bowl granulation can be used to carry out the formation operation.

The catalyst also includes a hydro-dehydrogenation function, provided, for example, by at least one element of Group VIII and preferably at least one noble element included in the group formed by platinum and palladium. The content by weight of non-noble metal of Group VIII, in relation to the final catalyst, is between 1 and 40%, preferably between 10 and 30%. In this case, the non-noble metal is often combined with at least one metal of Group VIB (Mo and W being preferred). If there is at least one noble metal of Group VIII, the content by weight, in relation to the final catalyst, is below 5%, preferably below 3% and still more preferably below 1.5%.

In the case of utilization of noble metals of Group VIII, the platinum and/or palladium are preferably located on the matrix.

The hydrodewaxing catalyst according to the invention can, moreover, contain 0 to 20%, preferably 0 to 10% by weight (expressed in oxides) of phosphorus. The combination of metal(s) of Group VI B and/or metal(s) of Group VIII with phosphorus is particularly advantageous.

The Treatment

A residue obtained at the end of stage (a) and of distillation, which it is advantageous to treat in this hydrodewaxing stage (b), has the following characteristics: it has an initial boiling point above 340° C. and preferably above 370° C., a pour point of at least 15° C., a viscosity index of 35 to 165 (before dewaxing), preferably at least equal to 110, and still more preferably below 150, a viscosity at 100° C. above or equal to 3 cSt ($mm^2/s$), a content of aromatic compounds below 10% by weight, a nitrogen content below 10 ppm by weight, a sulphur content below 50 ppm by weight or, better, 10 ppm by weight.

The operating conditions under which the catalytic stage of the process of the invention takes place are as follows:

- the reaction temperature is between 200 and 500° C., and preferably between 250 and 470° C., and advantageously 270-430° C.;
- the pressure is between 0.1 (or 0.2) and 25 MPa ($10^6$ Pa) and preferably between 1.0 and 20 MPa;
- the hourly volume rate (hvr expressed as the volume of charge injected per catalyst volume unit and per hour) is between approximately 0.05 and approximately 50 and preferably between approximately 0.1 and approximately 20 $h^{-1}$and, still more preferably, between 0.2 and 10 $h^{-1}$.

These are chosen so as to obtain the desired pour point.

Contact between the charge and the catalyst takes place in the presence of hydrogen. The rate of hydrogen used and expressed in litres of hydrogen per litre of charge is between 50 and approximately 2000 litres of hydrogen per litre of charge, and preferably between 100 and 1500 litres of hydrogen per litre of charge.

The Effluent Obtained

The effluent from the hydrodewaxing stage (b) is passed to the distillation train, which preferably includes atmospheric distillation and vacuum distillation, which aims to separate the conversion products with a boiling point below 340° C. and preferably below 370° C. (and including in particular those formed during the catalytic hydrodewaxing stage), and to separate the fraction which makes up the base oil, and whose initial boiling point is above at least 340° C. and preferably above or equal to 370° C.

Moreover, this vacuum distillation section makes it possible to separate the different grades of oils.

Preferably, before being distilled, at least part, and preferably all of the effluent from the catalytic hydrodewaxing stage (b), is passed to a hydrofinishing catalyst in the presence of hydrogen, in order to achieve accelerated hydrogenation of the aromatic compounds which are detrimental to the stability of the oils and distillates. However the acidity of the catalyst must be sufficiently low not to lead to the formation of cracked product with a boiling point below 340° C., so as not to degrade the final yields of oils in particular.

The catalyst used in this stage comprises at least one metal of Group VIII and/or at least one element of Group VIB of the periodic table. Strong metallic functions: platinum and/or palladium, or nickel-tungsten, or nickel-molybdenum combinations will be advantageously used to achieve an accelerated hydrogenation of the aromatics.

These metals are deposited and dispersed on a support of the crystalline or amorphous oxide type, such as for example, aluminas, silicas, silica-aluminas.

The hydrofinishing (HDF) catalyst can also contain at least one element of Group VII A of the periodic table of the elements. These catalysts preferably contain fluorine and/or chlorine.

The contents by weight of metals are between 10 and 30% in the case of the non-noble metals and below 2%, preferably between 0.1 and 1.5%, and still more preferably between 0.1 and 1.0% in the case of the noble metals.

The total quantity of halogen is between 0.02 and 30% by weight, advantageously 0.01 to 15%, or 0.01 to 10%, preferably 0.01 to 5%.

Among the catalysts that can be used in this hydrofinishing stage, leading to excellent performances, and in particular to obtain medicinal oils, mention may be made of the catalysts containing at least one noble metal of Group VIII (platinum for example) and at least one halogen (chorine and/or fluorine), a combination of chlorine and fluorine being preferred.

The operating conditions under which the hydrofinishing stage of the process according to the invention takes place are as follows:

- the reaction temperature is between 180 and 400° C., preferably between 210 and 350° C., advantageously 230-320° C.;
- the pressure is between 0.1 and 25 MPa (106 Pa) and preferably between 1.0 and 20 MPa;
- the hourly volume rate (hvr expressed as the volume of charge injected per catalyst volume unit and per hour) is between approximately 0.05 and approximately 100 and preferably between approximately 0.1 and approximately 30 $h^{-1}$.

Contact between the charge and the catalyst takes place in the presence of hydrogen. The rate of hydrogen used and expressed in litres of hydrogen per litre of charge is between 50 and approximately 2000 litres of hydrogen per litre of charge, and preferably between 100 and 1500 litres of hydrogen per litre of charge.

Advantageously, the temperature of the hydrofinishing (HDF) stage is lower than the temperature of the catalytic hydrodewaxing (CHDW) stage. The difference between $T_{CHDW}$ and $T_{HDF}$ is generally between 20 and 200 and preferably between 30 and 100° C.

The effluent from HDF is passed to the distillation train.

The Products

The base oils obtained according to this process have a pour point below −10° C., a VI above 95, preferably above 110 and still more preferably above 120, a viscosity of at least 3.0 cSt at 100° C., an ASTM colour below 1, and UV stability such that the ASTM colour increase is between 0 and 4, and preferably between 0.5 and 2.5.

The UV stability test, adapted from the ASTM D925-55 and D1148-55 processes, provides a quick method for comparing the stability of lubricating oils exposed to a source of ultraviolet rays. The test chamber is made up of a metal enclosure with a turning plate on which the oil samples are placed. A bulb producing the same ultraviolet rays as those of sunlight, and positioned at the top of the test chamber, is directed downwards onto the samples. The samples include a standard oil with known UV characteristics. The ASTM D1500 colour of the samples is determined at t=0, then after 45 hours of exposure at 55° C. The results are transcribed for the standard sample and the test samples as follows:

a) initial ASTM D1500 colour,
b) final ASTM D1500 colour,
c) increase in colour,
d) cloudy,
e) precipitate.

Another advantage of the process according to the invention is that it is possible to achieve very low aromatics contents, less than 2% by weight, preferably less than 1% by weight and, better, less than 0.05% by weight), even going so far as to produce medical-grade white oils having aromatics contents of less than 0.01% by weight. These oils have UV absorbance values at 275, 295 and 300 nanometres respectively of less than 0.8, 0.4 and 0.3 (ASTM D2008 method) and a Saybolt colour between 0 and 30.

Thus, particularly advantageously, the process according to the invention also makes it possible to obtain medicinal white oils. Medicinal white oils are mineral oils obtained by accelerated refining of oil, their quality is subject to various regulations aimed at guaranteeing their harmlessness for pharmaceutical applications, they are non-toxic and are characterized by their density and viscosity. Medicinal white oils are essentially made up of saturated hydrocarbons, they are chemically inert and have a low aromatic hydrocarbons content. Particular attention is paid to the aromatic compounds and in particular to 6 polycyclic aromatic hydrocarbons (P.A.H.) which are toxic and present in concentrations of one part per billion by weight of aromatic compounds in the white oil. The total aromatics content can be checked by the method ASTM D 2008; this UV adsorption test at 275, 292 and 300 nanometres makes it possible to check an absorbance below 0.8, 0.4 and 0.3 respectively (i.e. these white oils have aromatics contents below 0.01% by weight). These measurements are carried out with concentrations of 1 g of oil per litre, in a 1 cm container. Commercial white oils are differentiated by their viscosity but also by their original crude, which may be paraffinic or naphthenic; these two parameters will lead to differences in both the physico-chemical properties of the white oils under consideration, and also their chemical composition.

Currently oil cuts whether originating from direct distillation of a crude oil followed by extraction of the aromatic compounds by a solvent, or resulting from the catalytic hydrorefining or hydrocracking process, still contain not insignificant quantities of aromatic compounds. Under the current legislation of most industrialized countries, "medicinal" white oils must have an aromatics content below a threshold imposed by the law of each of these countries. The absence of these aromatic compounds from the oil cuts is shown by a Saybolt colour specification which must be clearly at least 30 (+30), a maximum UV adsorption specification which must be below 1.60 to 275 nm on a pure product in a 1 centimeter container and a maximum specification for absorption of DMSO extraction products which must be below 0.1 for the American market (Food and Drug Administration Standard no. 1211145). This last test consists of specifically extracting polycyclic aromatic hydrocarbons using a polar solvent, often DMSO, and checking their content in the extract by a UV absorption measurement in the range 260-350 nm.

FIGURES

Figure 2:
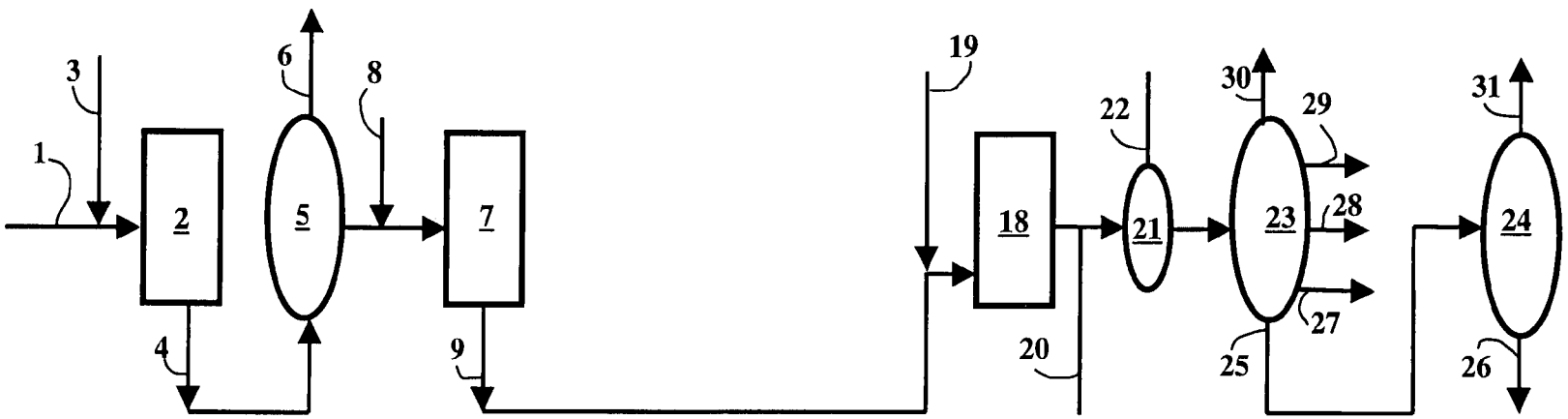
Figure 3:
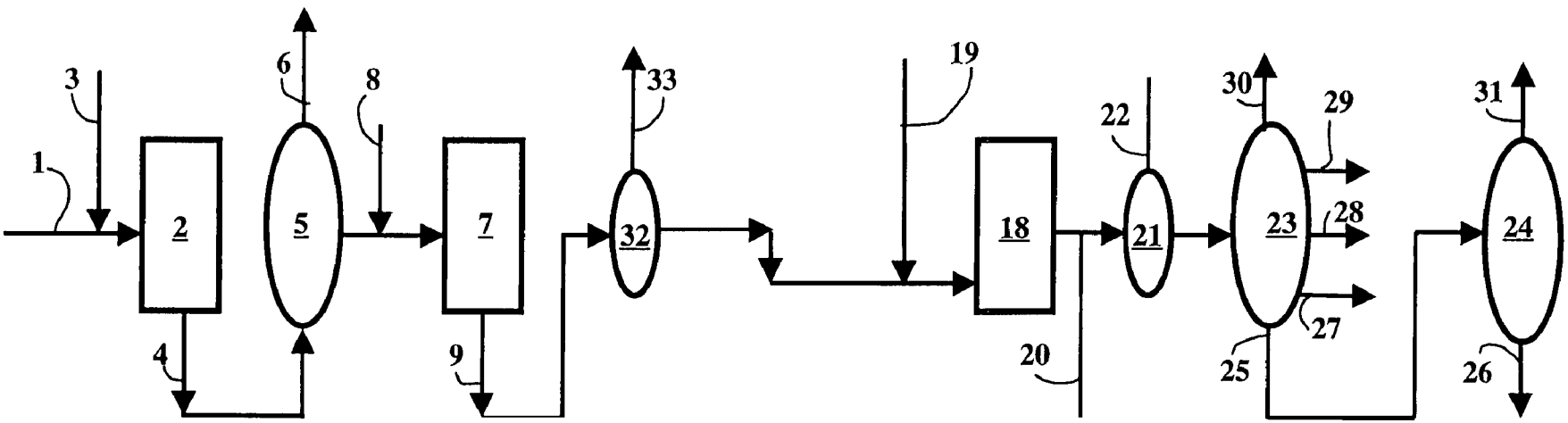

The invention is illustrated by FIGS. 1 to 3, representing different embodiments for the treatment according to the invention of a charge, for example, resulting from the Fischer-Tropsch process, or of a hydrocracking residue.

FIG. 1.

In FIG. 1, the charge enters via the line (1) into a hydrotreatment zone (2) (which can be made up of one or more reactors, and comprise one or more catalytic beds of one or more catalysts), which hydrogen enters (for example via the line (3)) and where the hydrotreatment stage is carried out.

The hydrotreated charge is transferred via the line (4) into the hydroisomerization zone (7) (which can be made up of one or more reactors, and comprise one or more catalytic beds of one or more catalysts), where, in the presence of hydrogen, the hydroisomerization stage (a) is carried out. Hydrogen can be supplied via the line (8).

In this figure, before being introduced into the zone (7), the charge to be hydroisomerized has much of its water removed in the flask (5), the water leaving via the line (6), and optionally ammonia and hydrogen sulphide $H_2S$, if the charge entering via the line 1 contains sulphur and nitrogen.

The effluent from the zone (7) is passed via a line (9) into a flask (10) for separation of the hydrogen which is extracted via a line (11), the effluent is then distilled at atmospheric pressure in the column (12), from where is extracted, overhead, via the line (13), a light fraction containing the compounds with at most 4 carbon atoms, and those boiling lower.

At least one gasoline fraction (14) is also obtained, and at least one middle distillate fraction (kerosene (15) and gasoil (16) for example).

At the base of the column, a fraction is obtained containing the compounds with a boiling point above at least 340° C. This fraction is evacuated via the line (17) to the catalytic dewaxing zone (18).

The catalytic dewaxing zone (18) (comprising one or more reactors, one or more catalytic beds of one or more catalysts) also receives hydrogen via a line (19) in order to carry out stage (b) of the process.

The effluent obtained, leaving via the line (20) is separated in a distillation train comprising, apart from the flask (21) in order to separate the hydrogen via a line (22), an atmospheric distillation column (23) and a vacuum column (24) which treats the atmospheric distillation residue transferred via the line (25), residue with an initial boiling point above 340° C.

There are obtained as products of the distillation processes: an oil fraction (line 26) and lower boiling fractions, such as gasoil (line 27), kerosene (line 28), gasoline (line 29); the light gases being removed via the line (30) from the atmospheric column and via the line (31) from the vacuum distillation column.

The effluent leaving via the line (20) can advantageously be passed into a hydrofinishing zone (not represented) (comprising one or more reactors, one or more catalytic beds of one or more catalysts). Hydrogen can be added in this zone if needed. The effluent leaving is then transferred to the flask (21) and the distillation train described.

To keep the figure simple, the hydrogen recycling has not been represented, either at the level of the flask (10), towards the hydrotreatment and/or hydroisomerization section, and/or at the level of the flask (21) towards the dewaxing and/or hydrofinishing section.

FIG. 2.

The references from FIG. 1 will be found repeated here. In this embodiment, all the effluent from the hydroisomerization-conversion zone (7) (stage a) passes directly via the line (9) into the catalytic dewaxing zone (18) (stage b).

FIG. 3.

As previously, the references from FIG. 1 have been retained. In this embodiment, the effluent from the hydroisomerization-conversion zone (7) (stage a) undergoes, in the flask (32), a separation of at least some of the light gases (hydrogen and hydrocarbon compounds with at most 4 carbon atoms), for example by flash. The separated gases are extracted via the line (33) and the residual effluent is passed via the line (34) into the catalytic dewaxing (18) zone.

It will be noted that, in FIGS. 1, 2 and 3, a separation section has been provided for the effluent from the catalytic dewaxing zone (18). This separation cannot be implemented when said effluent is treated subsequently in a hydrofinishing zone, the separation then occurring after said treatment.

This is the separation carried out in the flasks or columns 21, 23, 24.

The invention claimed is:

1. A process for the production of oils from a hydrocarbon charge, said process comprising the following successive stages:

(a) conversion of the charge with simultaneous hydroisomerization of at least some of the n-paraffins in the charge, said charge having a sulphur content of less than 1000 ppm by weight, a nitrogen content of less than 200 ppm by weight, a metals content of less than 50 ppm by weight, an oxygen content of at most 0.2% by weight, in the presence of a catalyst containing at least one noble metal applied to an amorphous acid support, the noble metal dispersion is less than 20%, (b) catalytic dewaxing of at least part of the effluent produced in stage (a) in the presence of a catalyst containing at least one hydro-dehydrogenating element and molecular sieve ZBM-30.

2. A process according to claim 1, in which stage (a) takes place at a temperature of 200-500° C., under a pressure of 2-25 MPa, at a volume rate of 0.1-10 $h^{-1}$, in the presence of hydrogen, at a rate between 100 and 2000 litres of hydrogen/litre of charge, stage (b) takes place at a temperature of 200-500° C., under a pressure of 1-25 MPa, at an hourly volume rate of 0.05-50 $h^{-1}$, and in the presence of 50-2000 litres of hydrogen/litre of effluent entering stage (b).

3. A process according to claim 2, in which all the effluent from stage (a) is treated in stage (b).

4. A process according to claim 1, in which the effluent produced in stage (a) is distilled in order to separate the light gases and at least one residue containing the compounds with a boiling point above at least 340° C., said residue being subjected to stage (b).

5. A process according to claim 1, in which the effluent produced in stage (b) is distilled in order to separate an oil containing the compounds with a boiling point above at least 340° C.

6. A process according to claim 5, comprising an atmospheric distillation followed by a vacuum distillation of the atmospheric residue.

7. A process according to claim 1, in which the charge subjected to stage (a) has previously undergone a hydrotreatment then optionally a separation of water, ammonia and hydrogen sulphide.

8. A process according to claim 1, wherein the catalyst of stage (a) comprises at most 2% by weight of noble metal particles less than 2 nm in size based on said noble metal in the catalyst.

9. A process according to claim 1, characterized in that in wherein the catalyst of stage (a) comprises at least 70% of noble metal particles greater than 4 nm in size.

10. A process according to claim 1, characterized in that the support comprises at least one of a silica-alumina, a halogenated alumina, an alumina doped with silicon, a titanium oxide-alumina mixture, a sulphated zirconia, and a zirconia doped with tungsten.

11. A process according to claim 9, characterized in that the support moreover comprises at least one amorphous matrix chosen from the group formed by alumina, titanium oxide, silica, boron oxide, magnesia, zirconia, clay.

12. A process according to claim 1, characterized in that the support consists essentially of an amorphous silica-alumina.

13. A process according to claim 1, characterized in that the support of stage (a) contains 1-95% by weight of silica and the catalyst contains 0.05-10% by weight of noble metal.

14. A process according to claim 1, characterized in that the noble metal of the catalyst of stage (a) and the hydro-dehydrogenating metal of the catalyst of stage (b) comprises at least one of platinum and palladium.

15. A process according to claim 1, in which the catalytic dewaxing catalyst further comprises at least one zeolite chosen from the group consisting of Nu-10, EU-1, EU-13, ferrierite, ZSM-22, theta-1, ZSM-50, ZSM-23, Nu-23, ZSM-35, ZSM-38, ZSM-48, ISI-1, KZ-2, ISI-4, KZ-1.

16. A process according to claim 1, in which the effluent produced in stage (b) is subjected to a hydrofinishing stage before being distilled.

17. A process according to claim 1, in which the hydrocarbon charge treated contains at least 20% by volume of compounds boiling above 340° C.

18. A process according to claim 1, in which the hydrocarbon charge treated is chosen from effluents resulting from a Fischer-Tropsch unit, vacuum distillates resulting from the direct distillation of crude, vacuum distillates resulting from conversion units, vacuum distillates originating from aromatics extraction units, vacuum distillates originating from desulphuration or hydroconversion of atmospheric residues and/or vacuum residues, deasphalted oils, hydrocracking residues or any mixture of said charges.

19. A process according to claim 1, wherein the noble metal dispersion is greater than 5%.

20. A process according to claim 1, wherein the noble metal dispersion is greater than 1%.

21. A process according to claim 1, wherein the hydrocarbon charge is an effluent produced in a Fischer-Tropsch unit.

* * * * *